US008342890B2

(12) United States Patent
Zhu

(10) Patent No.: US 8,342,890 B2
(45) Date of Patent: Jan. 1, 2013

(54) LOW PROFILE ELECTRICAL CONNECTOR WITH TWO ROWS OF CONTACTS

(75) Inventor: Yu Zhu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 159 days.

(21) Appl. No.: 12/876,233

(22) Filed: Sep. 6, 2010

(65) Prior Publication Data

US 2011/0244731 A1 Oct. 6, 2011

(30) Foreign Application Priority Data

Mar. 31, 2010 (CN) ..... 2010 2 0146299 U

(51) Int. Cl.
*H01R 13/10* (2006.01)

(52) U.S. Cl. ..... 439/682

(58) Field of Classification Search ..... 439/74, 439/682

See application file for complete search history.

(56) References Cited

U.S. PATENT DOCUMENTS 1,325,865 A * 12/1919 Shreeve ..... 439/617
1,684,973 A * 9/1928 Sears ..... 439/521
2,977,562 A * 3/1961 Benson ..... 439/58
3,016,512 A * 1/1962 Borchard ..... 439/225
3,786,208 A * 1/1974 Edwards ..... 200/51 R
3,874,759 A * 4/1975 Colombo ..... 439/525
3,923,361 A * 12/1975 Rosen ..... 439/264
4,155,612 A * 5/1979 Silverio ..... 439/52
4,232,923 A * 11/1980 Otsuki et al. ..... 439/65
4,522,455 A * 6/1985 Johnson ..... 439/92
4,567,654 A * 2/1986 Kloenne et al. ..... 29/876
4,576,654 A * 3/1986 Eddens et al. ..... 148/520
4,717,349 A * 1/1988 Johnson ..... 439/92
4,934,945 A * 6/1990 Nakamura ..... 439/75
5,046,954 A * 9/1991 Schmedding ..... 439/70
5,122,066 A * 6/1992 Plossmer ..... 439/78
5,145,386 A * 9/1992 Berg et al. ..... 439/83
5,169,322 A * 12/1992 Frantz et al. ..... 439/82
5,188,535 A * 2/1993 Bertho et al. ..... 439/83
5,197,891 A * 3/1993 Tanigawa et al. ..... 439/83
5,263,883 A * 11/1993 Kirayoglu ..... 439/856
5,281,160 A * 1/1994 Walkup et al. ..... 439/266
5,556,285 A * 9/1996 Ono ..... 439/74
5,641,291 A * 6/1997 Sueki et al. ..... 439/83
5,685,726 A * 11/1997 Lwee et al. ..... 439/83
5,919,051 A * 7/1999 Mitra ..... 439/74
5,938,456 A * 8/1999 Kozel et al. ..... 439/83
6,027,354 A * 2/2000 Bowers et al. ..... 439/225
6,293,816 B1 * 9/2001 Scheitz et al. ..... 439/441

(Continued)

*Primary Examiner* — Neil Abrams

(74) *Attorney, Agent, or Firm* — Wei Te Chung; Ming Chieh Chang

(57) ABSTRACT

An electrical connector includes a plurality of contacts and an insulative housing. Each contact comprises a retaining portion, a contact portion contact portion and a tail portion, the contacts divided into a first group and a second group. The insulative housing defines a mating face and opposite first and second side faces. The insulative housing defines two rows of mating passageways extending in a first direction running through the mating face. The tail portions of the first group expose to the first side face and the contact portion contact portions of the first group project in one row of said two rows of the mating passageways. The tail portions of the second group expose to the second side face and the contact portion contact portions of the second group project in the other row of said two rows of the mating passageways.

16 Claims, 6 Drawing Sheets

U.S. PATENT DOCUMENTS

| | | | | |
|---|---|---|---|---|
| 6,488,551 | B1 * | 12/2002 | Tomlin et al. | 439/860 |
| 6,527,571 | B2 * | 3/2003 | Muta et al. | 439/246 |
| 6,652,294 | B1 * | 11/2003 | Zhang | 439/83 |
| 6,776,620 | B2 * | 8/2004 | Noda | 439/63 |
| 6,926,563 | B2 * | 8/2005 | Morana et al. | 439/682 |
| 7,097,470 | B2 * | 8/2006 | Harper, Jr. | 439/83 |
| 7,179,095 | B1 * | 2/2007 | Peng et al. | 439/74 |
| 7,320,606 | B2 * | 1/2008 | Midorikawa | 439/74 |
| 7,384,288 | B2 * | 6/2008 | Sano et al. | 439/189 |
| 7,757,929 | B2 * | 7/2010 | Ice et al. | 228/180.21 |
| 7,828,585 | B2 * | 11/2010 | Kurimoto | 439/468 |
| 8,183,155 | B1 * | 5/2012 | Little et al. | 438/682 |
| 8,192,217 | B2 * | 6/2012 | Zhu | 439/284 |
| 2011/0244731 | A1 * | 10/2011 | Zhu | 439/660 |
| 2011/0294351 | A1 * | 12/2011 | Zhu | 439/638 |
| 2012/0052711 | A1 * | 3/2012 | Hasegawa | 439/345 |

* cited by examiner

LOW PROFILE ELECTRICAL CONNECTOR WITH TWO ROWS OF CONTACTS

BACKGROUND OF THE INVENTION

1. Field of the Invention

The present invention relates to an electrical connector, and more particularly to a low profile electrical connector with two rows of contacts having staggered contact portions.

2. Description of the Related Art

A traditional electrical connector comprises an insulative housing and a plurality of contacts received in the insulative housing. Each contact defines a retaining portion, an elastic contact portion contacting with a mating electrical connector and a soldering portion welding to a print circuit board (PCB). The contacts are arranged in two rows in a planar, so the electrical connector must have a transverse distance which can accommodate two contacts. The electrical connector occupies a big space on the PCB.

In view of the above, a new electrical connector that overcomes the above-mentioned disadvantages is desired.

SUMMARY OF THE INVENTION

Accordingly, an object of the present invention is to provide low profile electrical connector with two rows of contacts having staggered contact portions.

To fulfill the above-mentioned object, an electrical connector comprises a plurality of contacts and an insulative housing. Each contact comprises a retaining portion, a contact portion and a tail portion, the contacts divided into a first group and a second group. The insulative housing defines a mating face and opposite first and second side faces. The insulative housing defines two rows of mating passageways extending in a first direction running through the mating face. The tail portions of the first group expose to the first side face and the contact portions of the first group project in one row of said two rows of the mating passageways. The tail portions of the second group expose to the second side face and the contact portions of the second group project in the other row of said two rows of the mating passageways.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
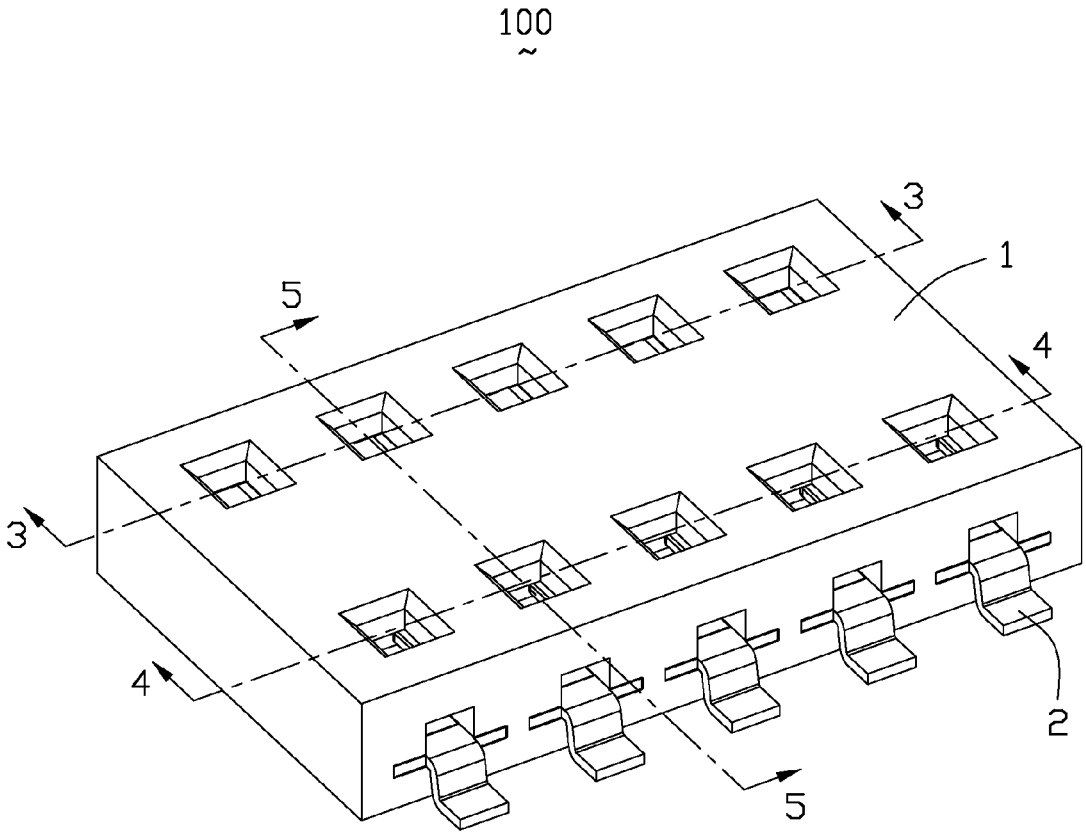
FIG. 1 is a perspective view of an electrical connector of the present invention.
Figure 2:
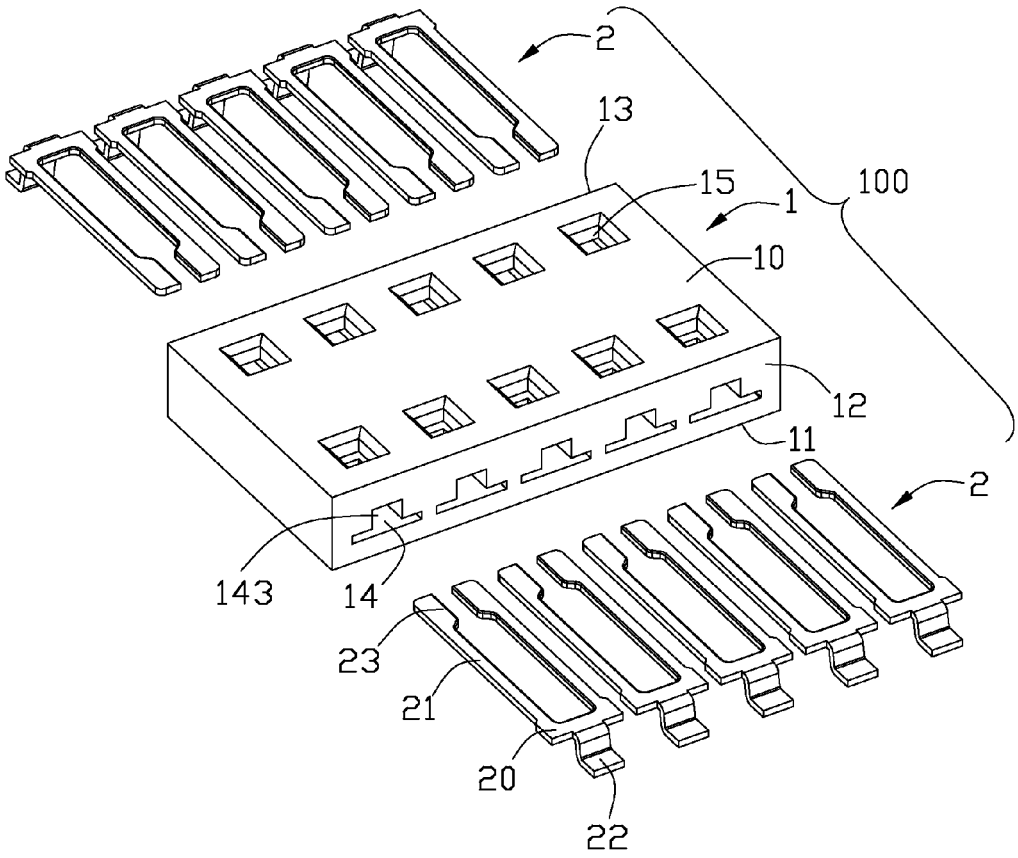
FIG. 2 is an exploded view of the electrical connector of FIG. 1.

Referring to FIGS. 1-2, an electrical connector 100 includes a rectangle board shaped insulative housing 1 and a plurality of contacts 2 assembled in the insulative housing 1.

Figure 3:
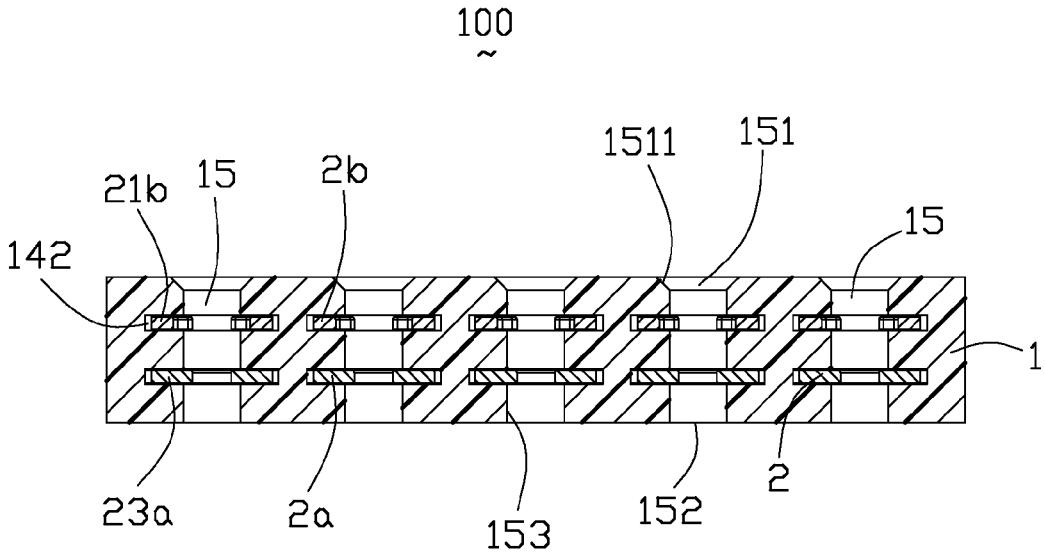
FIG. 3 is a cross sectional view of the electrical connector taken along 3-3 in FIG. 1.
Figure 5:
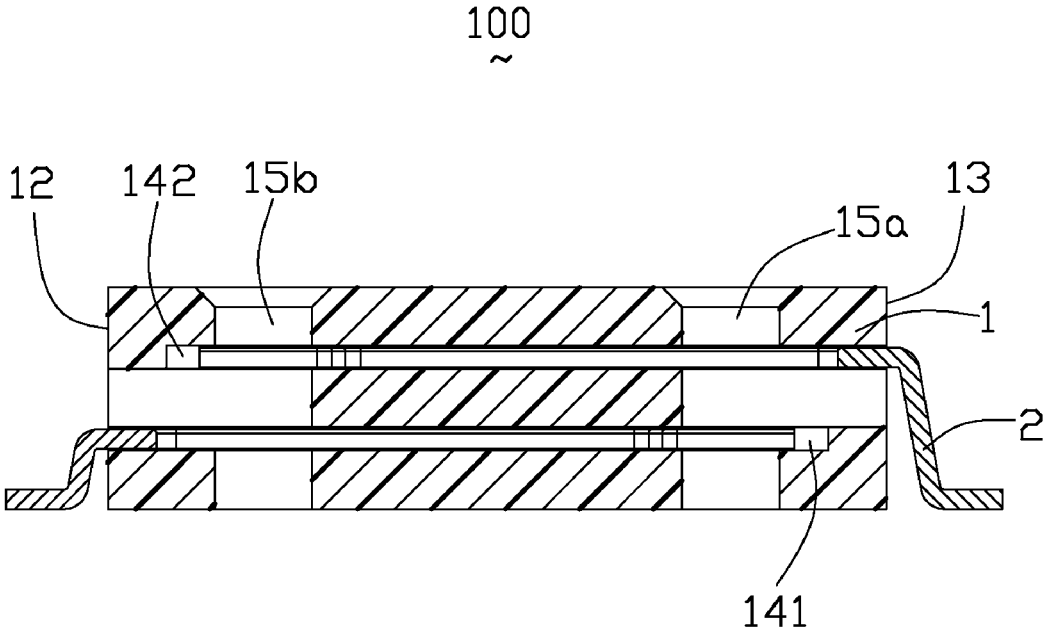
FIG. 5 is a cross sectional view of the electrical connector taken along 5-5 in FIG. 1.

Referring to FIG. 2, the insulative housing 1 defines a mating face 10, a mounting face 11 opposite to the mating face 10, and opposite first and second side faces 12, 13 bridging the mating face 10 and the mounting face 11. The insulative housing 1 defines a plurality of mating passageways 15 arranged in two rows in a transverse direction and each row extends in a longitudinal direction. Each mating passageway 15 extends along a height direction perpendicular to the transverse direction and runs through the mating face 10 and the mounting face 11 as shown in FIG. 3 to form a plurality of quadrangle opening 151, 152 respectively on the mating face 10 and the mounting face 11. The quadrangle opening 151 on the mating face 10 defines guiding face 1511 extending slantly. Referring to FIGS. 2 and 5, the insulative housing 1 further defines two rows of receiving passageways 14 arranged in the height direction and respectively extending from the first and second side faces 12, 13. The first receiving passageways 141, i.e., the lower receiving passageways run through the first side face 12 and not through the second side face 13 while the second receiving passageways 142, i.e., the upper receiving passageways run through the second side face 13 and not through the first side face 12. The second receiving passageways 142 are arranged above and aligned with the first receiving passageways 141 in the height direction. The two rows of receiving passageways 14 intersect perpendicularly with corresponding two mating passageways 15 and associate with corresponding two mating passageways 15 in the transverse direction. The insulative housing 1 further defines grooves 143 above the first receiving passageways 141 or below the second receiving passageways 142 adjacent to the side faces 12, 13.

Referring to FIG. 2, the contacts 2 are arranged in two rows in the height direction and are inserted into the receiving passageways 14 of the insulative housing 1 respectively from the first side face 12 or the second side face 13. Each contact 2 made from a metal sheet defines a retaining portion 20, a pair of elastic arms 21 extending from two opposite ends of a first face of the retaining portion 20 and a tail portion 22 extending from a second face opposite to the first face of the retaining portion 20. The retaining portion 20 and the pair of elastic arm 21 are in the same plane and configured with a U-shaped manner. The retaining portion 20 is wider than the other parts of the contact 2 so as to be retained in the insulative housing 1. The tail portions 22 extends out of the insulative housing 1 from the side face 12 or 13 in the transverse direction and are intended to be welded to a print circuit board (not shown). The pair of elastic arms 21 defines contact portions 23 by widen distal ends thereof, which faces to each other. The contact portions 23 are configured with a board shaped.

Figure 4:
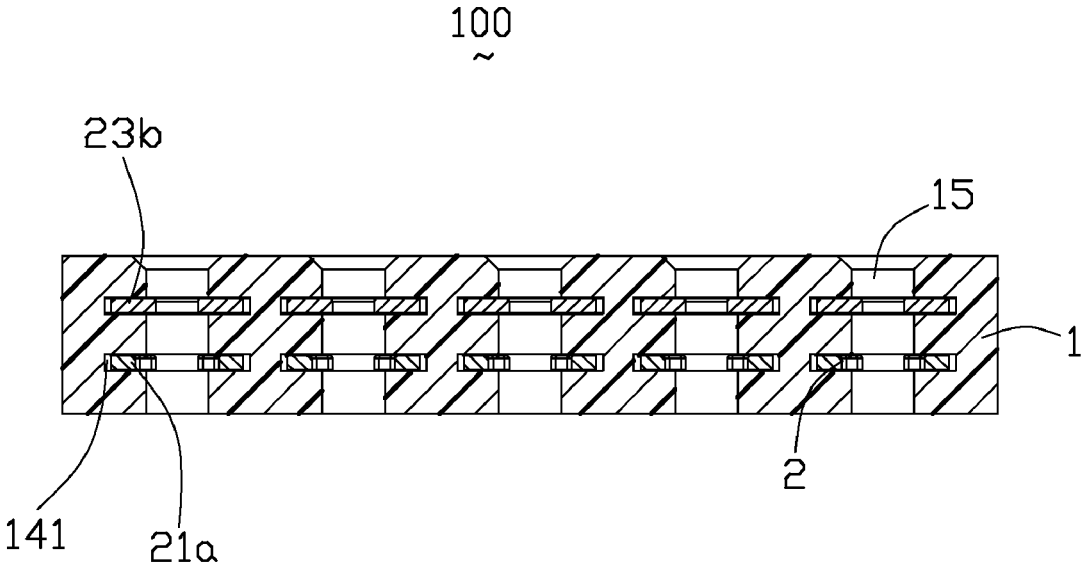
FIG. 4 is a cross sectional view of the electrical connector taken along 4-4 in FIG. 1.
Figure 6:
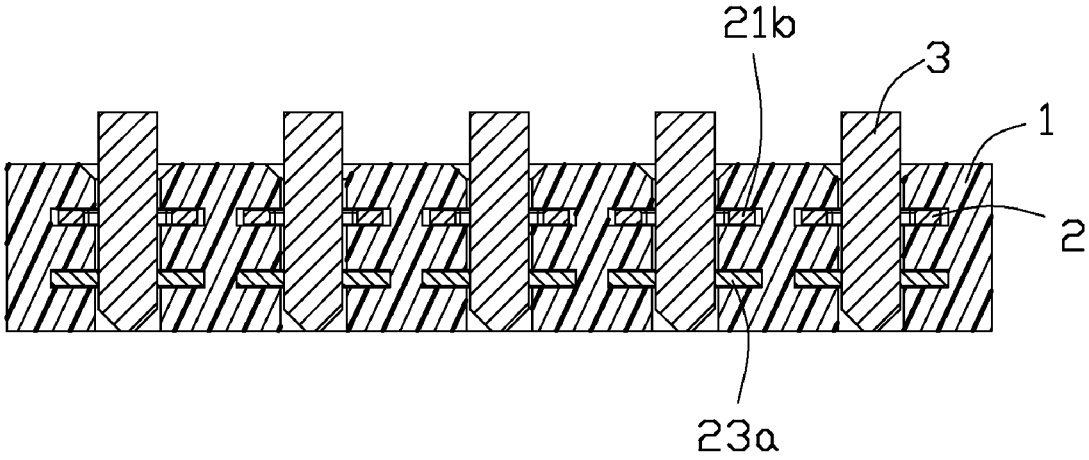
FIG. 6 is a cross sectional view of the electrical connector similar to FIG. 3 which is inserted with mating contacts.

Referring to FIGS. 3-5, the mating passageways 15 are lined in each row and said two rows are parallel to each other. Each two adjacent mating passageways 15 in different rows are spaced from each other while intersect with corresponding one first receiving passageway 141 simultaneously. Similarly, said each two adjacent mating passageways 15 in different rows also intersect with corresponding one second receiving passageway 142 simultaneously. The elastic arms 21 are contained in the receiving passageways 14 and do not project beyond the inside faces 153 of the mating passageways 15 while the contact portions 23 project in the mating passageways 15 since the elastic arms 21 are narrow. As best shown in FIG. 3, the contact portions 23*a* of the lower contacts 2*a* protrude in the correspond mating passageways 15*a* close to the second side face 13 while elastic arms 21*b* of the upper contacts 2*b* are hidden in the receiving passageways 142. Similarly as shown in FIG. 4, the contact portions 23*b* of the upper contacts 2*b* protrude in the mating passageways 15*b* close to the first side face 12 while elastic arms 21*a* are hidden in the receiving passageways 141. As a result, each mating passageway 15 is provided only one pair of contact portions 23*a* or 23*b* to mating with a mating contact 3 of a mating connector (not shown), for example in FIG. 6, a row of the mating contacts 3 just contacts with contact portions 23*a* received in the first/lower receiving passageway 141 and never contacts with the elastic arms 21*b* received in the second/upper receiving passageway 142.

Said two rows of contacts 2 are inserted from two opposite side faces respectively and the contact portions 23 extend to the opposite side faces. The two rows of contacts 2 are configured with the same shaped except for the length of the tail portions 22 to the mounting face 11. The tail portions 22 of the lower contacts 2*a* are shorter than the tail portion 22 of the higher contacts 2*b*.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a plurality of contacts, each comprising a retaining portion, a contact portion and a tail portion, the contacts divided into a first group and a second group;

an insulative housing defining a mating face and opposite first and second side faces, the insulative housing defining two rows of mating passageways extending in a first direction running through the mating face; wherein the tail portions of the first group expose to the first side face and the contact portions of the first group project in one row of said two rows of the mating passageways, the tail portions of the second group expose to the second side face and the contact portions of the second group project in the other row of said two rows of the mating passageways;

wherein said one row of said two rows of the mating passageways is adjacent to the second side face and the other row is adjacent to the first side face;

wherein the second group of the contacts is disposed above the first group.

2. The electrical connector as claimed in claim 1, wherein each contact further comprises an elastic arm extending from the retaining portion, the contact portion is formed at a free end of the elastic arm, and the elastic arm is hidden in the insulative housing and do not project in the mating passageway.

3. The electrical connector as claimed in claim 2, wherein the insulative housing define a plurality of first receiving passageways to receive the first group of the contacts and a plurality of second receiving passageways to receive the second group of the contacts, each first receiving passageway intersects with every two adjacent mating passageways of different rows, each second receiving passageway also intersects with said every two adjacent mating passageways of different rows.

4. The electrical connector as claimed in claim 3, wherein the first row of receiving passageways run through the first side face and not through the second side face while the second row of receiving passageways run through the second side face and not through the first side face.

5. The electrical connector as claimed in claim 4, wherein the first group of contacts and the second group of contacts are configured with the same shaped except for the length of the tail portions to a mounting face opposite to the mating face.

6. An electrical connector, comprising:

an insulative housing defining a mating face, rows of mating passageways running through the mating face in a first direction, first receiving passageways and second receiving passageways above the first receiving passageways in the first direction and extending in a second direction perpendicular to the first direction;

a plurality of contacts received in the first and second receiving passageways and comprising contact portions; wherein each mating passageway intersects with one first receiving passageway and one second receiving passageway above the first receiving passageway, each first receiving passageway intersects with two adjacent mating passageways in different rows, each second receiving passageway intersects with said two adjacent mating passageways in different rows, each mating passageway is disposed with only one contact portion.

7. The electrical connector as claimed in claim 6, wherein the contact portions are in the same row of the mating passageway in a plane.

8. The electrical connector as claimed in claim 7, wherein the contacts extend in the second direction and comprise tail portions exposing to the insulative housing.

9. The electrical connector as claimed in claim 8, wherein the tail portions of the contacts which have contact portions in one row of the mating passageway are disposed adjacent to another adjacent row of the mating passageway.

10. An electrical connector assembly comprising:

an insulative housing defining upper and lower rows of contact receiving passageways respectively horizontally extending inwardly from opposite first and second side walls thereof toward each other;

upper and lower rows of contacts inserted into the corresponding upper and lower contact receiving passageways from said opposite first and second side walls toward each other, respectively, each of said contacts defining a horizontal section with a contact section at a free end; and first and second rows of mating passageways respectively extending downwardly from a top face of the housing and intersecting at least the corresponding upper and lower rows of contact receiving passageways and the associated upper and lower rows of contacts therein, respectively; wherein each of said mating passageways is located laterally adjacent to one of said side walls and farther from the other under condition that for the corresponding contact intersecting said mating passageway extends from the other of said side walls, the horizontal section of said corresponding contact extends laterally and horizontally with a distance similar to a lateral dimension of the housing with the corresponding contact section vertically aligned with the corresponding mating passageway.

11. An electrical connector assembly as claimed in claim 10, wherein said first and second rows of mating passageways are configured to be adapted for allowing first and second rows of pin type terminals of a complementary connector to be downwardly inserted into the corresponding first and second mating passageways from the top face to couple to the corresponding upper and lower rows of contacts.

12. The electrical connector assembly as claimed in claim 11, wherein the upper row of the contact receiving passageways are vertically aligned with the lower row of the corresponding contact receiving passageways, respectively, so that for the mating passageways intersecting the lower row of passageways, also intersect the corresponding aligned upper row of contact receiving passageways, respectively.

13. The electrical connector assembly as claimed in claim 12, wherein the contacting sections of the upper row of contacts in the corresponding upper row of contact receiving passageways are configured to allow the corresponding second row of pin type terminals of the complementary connector to pass therethrough without touch and further mechanically and electrically connect to the corresponding lower rows of contacts, respectively.

14. The electrical connector assembly as claimed in claim 10, wherein each of said contacts further includes a horizontal solder tail extending around the corresponding side wall from which said contact is inserted into the corresponding contact receiving passageway.

15. The electrical connector assembly as claimed in claim 10, wherein each of said mating passageways extends through the housing in a vertical direction.

16. The electrical connector assembly as claimed in claim 10, wherein the housing defines in each of said side walls a plurality of lateral openings horizontally extending inwardly to reach the corresponding mating passageways, respectively.

* * * * *